United States Patent [19]

Berger

[11] 4,340,314

[45] Jul. 20, 1982

[54] ENVELOPE FEEDING APPARATUS

[75] Inventor: Michael A. Berger, Richardson, Tex.

[73] Assignee: Datamarc, Inc., Richardson, Tex.

[21] Appl. No.: 162,590

[22] Filed: Jun. 24, 1980

[51] Int. Cl.[3] ..... B41J 11/58

[52] U.S. Cl. ..... 400/625; 271/3; 400/629

[58] Field of Search ..... 400/624–629; 271/2, 3, 4

[56] References Cited

U.S. PATENT DOCUMENTS

| | | | |
|---|---|---|---|
| 1,017,134 | 2/1912 | Carter . | |
| 1,135,140 | 4/1915 | Roberts . | |
| 1,182,052 | 5/1916 | Stocking et al. . | |
| 2,242,268 | 5/1941 | Sherman . | |
| 2,282,411 | 5/1942 | Sundstrand . | |
| 2,896,946 | 7/1959 | Barratt et al. . | |
| 3,430,748 | 3/1969 | Parri | 400/636 X |
| 3,586,312 | 6/1971 | Sammons | 271/2 |
| 4,067,566 | 1/1978 | Williams | 271/2 |
| 4,082,595 | 4/1978 | Slater | 156/351 |
| 4,143,981 | 3/1979 | Hansen et al. | 400/637.1 X |
| 4,222,557 | 9/1980 | Wu | 400/629 X |
| 4,275,969 | 6/1981 | Matsuhisa et al. | 400/629 X |

*Primary Examiner*—Paul T. Sewell

*Attorney, Agent, or Firm*—Hubbard, Thurman, Turner, Tucker & Glaser

[57] ABSTRACT

A compact substantially self contained envelope feeding apparatus includes a magazine for holding a plurality of stacked envelopes which are dispensed through a bottom outlet by a two stage dispensing mechanism comprising spaced apart sets of drive rollers arranged along an envelope feed path. The second set of drive rollers includes resiliently biased idler rollers for guiding the envelopes along a curved portion of the feed path to a holding plate which holds each envelope momentarily stationary for engagement by endless feed belts which feed the envelope to a platen of a printer. A support unit is provided with quick release clamps for securing the feeding apparatus to the support shaft of the printer platen. Drive gearing is provided for engagement with a platen gear to drive the feed belts in timed relation to the platen for feeding envelopes to the platen and returning envelopes from the platen back to the magazine. A control circuit includes a photosensor for timing the operation of the dispensing mechanism relative to the position of envelope engaging lugs on the feed belts, and a photosensor for signalling a jammed or out of paper condition.

43 Claims, 8 Drawing Figures

ENVELOPE FEEDING APPARATUS

BACKGROUND OF THE INVENTION

1. Field of the Invention

The invention pertains to apparatus for automatically feeding envelopes or other discrete pieces of sheet material to automatic or manual printing apparatus and for receiving the printed material from the printing apparatus for storage in a magazine.

2. Description of the Prior Art

Methods and apparatus for serially feeding envelopes and other sheet material to a printer are known and evermore widely used in connection with programmable printing machines such as automatic typewriters or so called word processing systems. Efforts have been made to develop apparatus which can selectively feed two or more types of material such as envelopes and forms or letterheads. Generally, such devices have become unduly complicated, are too cumbersome to be conveniently mounted on and removed from printers such as automatic and manual typewriters, and require interfacing with the controls of the printer itself. There are many applications for feeding apparatus for printing machines which require that only one type of envelope or form be fed during a particular printing operation.

Moreover, it is desired in many applications of envelope and sheet material feeders that the feeder be readily adaptable to be used in conjunction with printers manufactured by different concerns and having different drive mechanisms and controls. Accordingly, it is important to be able to provide an envelope feeder which is substantially self contained and is easily converted from use with one type of printer to use with another type of printer. An envelope feeder meeting the aforementioned criteria should also be compact, light-weight and portable to the extent so as to provide for relative ease in moving the feeder apparatus from one printer to another. Furthermore, prior art feeding apparatus are also characterized by being dependent on the controls of the printer for operation to feed the envelope or the like in properly timed relation to the printer platen operation. This control interfacing requires that the feed apparatus controls be specially adapted for each type of printer. This makes the feeding apparatus unduly complicated or even impossible to build for use with more than one specific type of printer.

In addition to the problems associated with prior art envelope feeding apparatus as regards portability and versatility there are also deficiencies that have not been entirely overcome regarding proper timing and separation of the serially fed envelopes or sheets, uncomplicated feed paths for the material being fed to and from the printer, proper alignment of the envelopes or sheets on entering the printer platen, and ease of correcting a jammed condition should one occur. These problems as well as other deficiencies that have been associated with prior art feeding apparatus have been overcome with the present invention.

SUMMARY OF THE INVENTION

The present invention provides an improved feeding apparatus for envelopes or other sheet material which is adapted for use with printing apparatus such as word processing systems and automatic or manual typewriters and the like as well as other types of printing apparatus which have a platen for receiving discrete pieces of sheet material or envelopes for performing printing operations thereon and for ejecting such materials after the printing operation.

The present invention provides an improved feeding apparatus for envelopes or other sheet material which is particularly adapted for use with a variety of printing apparatus such as automatic word processing typewriters as well as manual typewriters. In accordance with the present invention an envelope feeding apparatus is provided which is easily adapted to be driven by the drive mechanism of the platen of the printer for operating a pair of feed belts in timed relationship to the movement of the platen for feeding an envelope or the like into and out of the printer.

The present invention also provides an envelope feeding apparatus which is easily mounted on and removed from a printer having a cylindrical platen providing for receiving envelopes from the feeding apparatus and returning envelopes to the feeding apparatus after completion of the printing operation.

In accordance with one important aspect of the present invention envelopes or other discrete pieces of sheet material may be dispensed from a magazine by a set of powered drive rollers which are driven in timed relationship to a second set of powered drive rollers which provide for separation of the serially fed envelopes along the feed path leading to the printer platen. Both sets of rollers are advantageously driven by a drive belt which is in driving engagement with a motor controlled for intermittent operation by an uncomplicated and reliable control circuit.

In accordance with another important aspect of the present invention there is provided a pair of endless feed belts having spaced apart lugs for positively engaging the envelope for feeding same from a waiting position into the printer platen in proper alignment for the printing operation. Even though a relatively short and uncomplicated feed path is provided from the magazine of the feeding apparatus to the point of engagement of the envelope by the feed belts any misaligned or skewed condition experienced during the dispensing operation is easily corrected during the final feeding of the envelope into the printer. Moreover, the envelope feed belts are also operable to receive the printed envelope from the printer platen and return same to the magazine on the feeding apparatus.

A still further important feature of the present invention pertains to a control circuit for operating the feeding apparatus of the present invention which is not required to be interfaced with the printer or controls therefor. The controls associated with the envelope feeding apparatus of the present invention are dependent only on the positive driving of the feed belts by the platen drive mechanism but are capable of properly spacing successive serially fed envelopes to the printer and are operable to provide a warning signal in the event of a jammed condition of the material being fed or an out of paper condition of the feeding apparatus. Accordingly, the feeding apparatus of the present invention may be used as easily with manual typewriters or printing equipment as with more sophisticated automatic printer systems.

The arrangement of the separate motor driven dispensing mechanism of the feeding apparatus according to the present invention together with the uncomplicated independent control system provides for a substantially self contained unit which is also compact and easily mounted on and removed from various printing apparatus.

The abovedescribed superior features of the present invention as well as others will be recognized by those skilled in the art upon reading the detailed description of the preferred embodiment.

BRIEF DESCRIPTION OF THE DRAWINGS

FIG. 8 is a schematic of the control system for the feeding apparatus of the present invention.

DESCRIPTION OF THE PREFERRED EMBODIMENT

Figure 1:
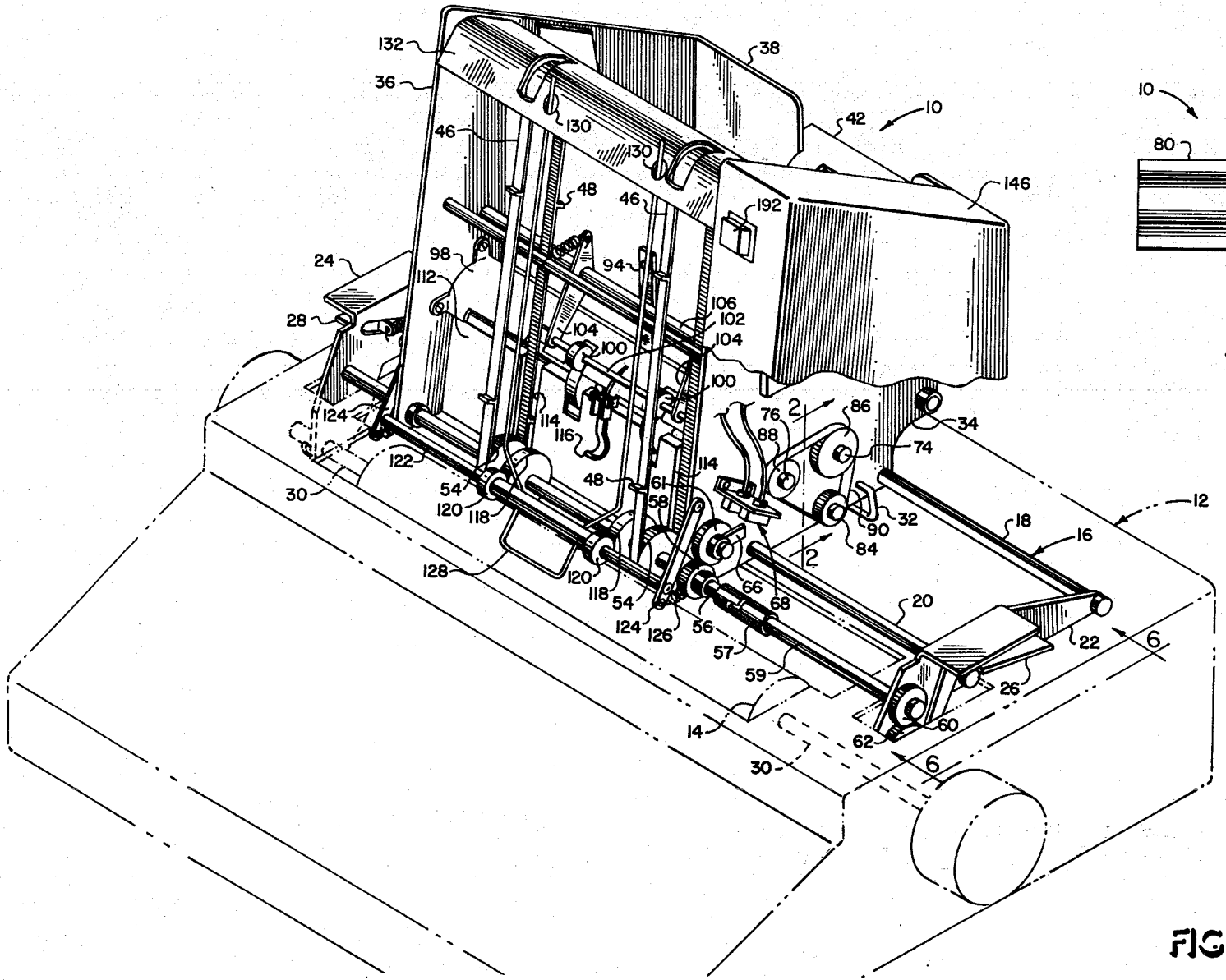
FIG. 1 is a perspective view of the feeding apparatus of the present invention shown mounted on a printer.
Figure 3:
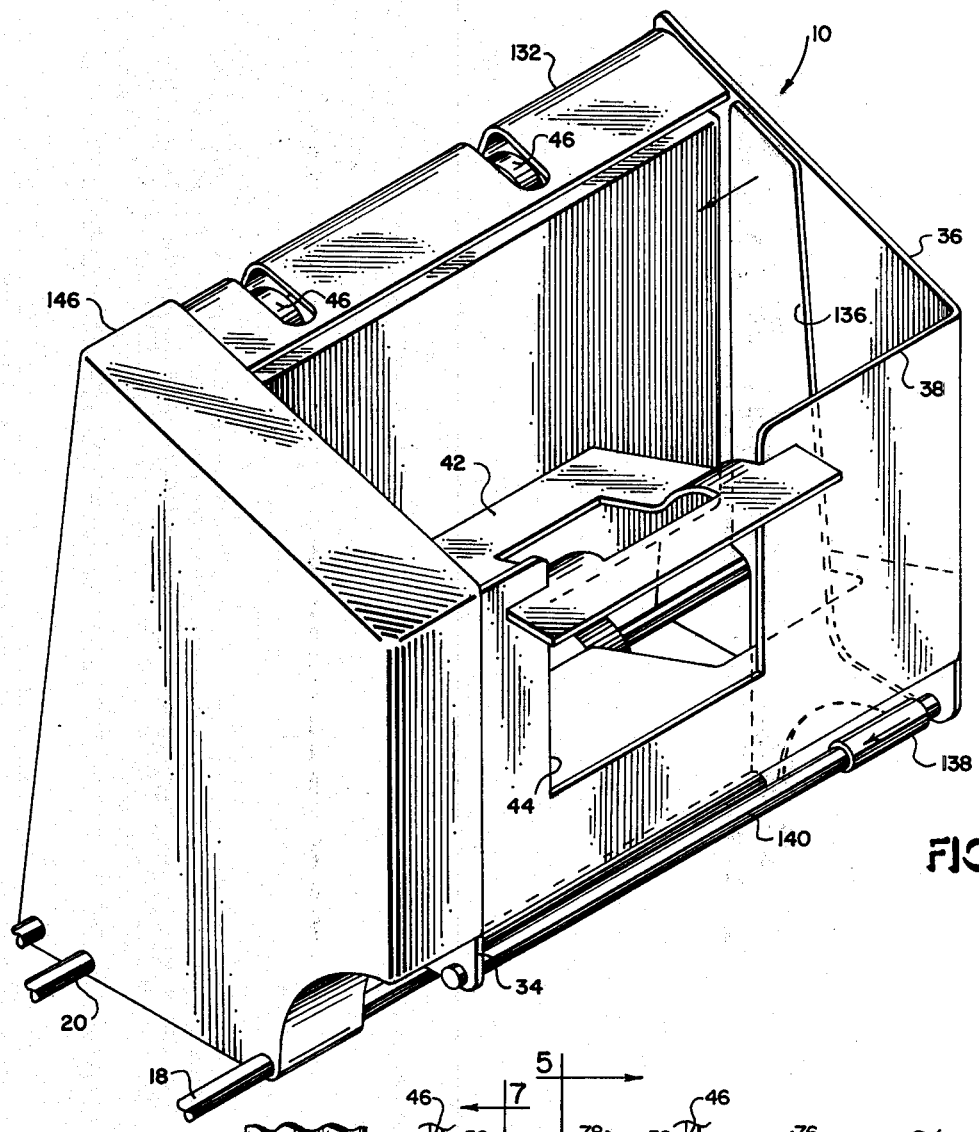
FIG. 3 is a perspective view showing the back side of the feeding apparatus including the envelope magazine.
Figure 6:
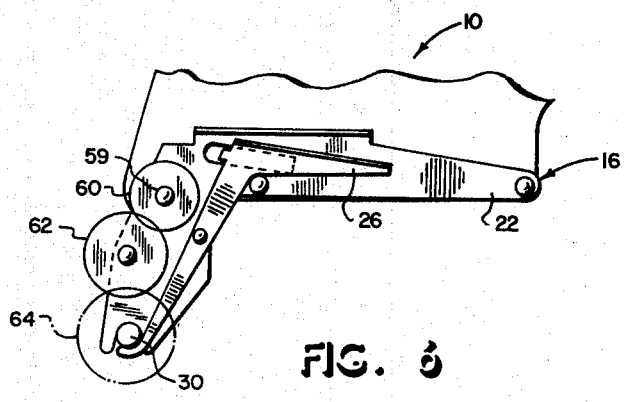
FIG. 6 is a detail view taken from the line 6—6 of FIG. 1 of one of the quick release clamps and also showing the feed belt drive gearing.
Figure 3:
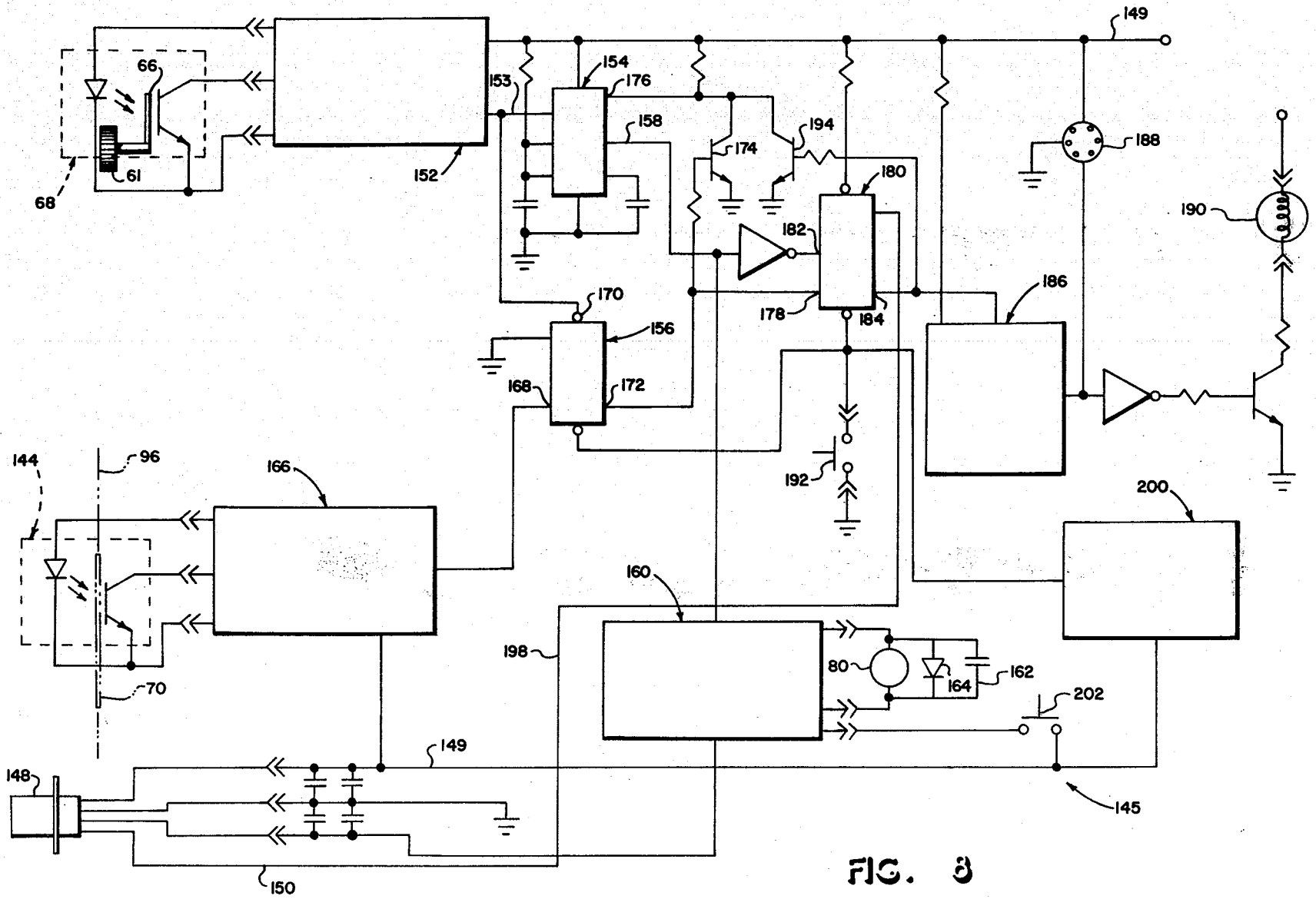

Referring to the drawings and in particular FIGS. 1 and 3 the feeding apparatus of the present invention is shown and generally designated by the numeral 10. The apparatus 10 is particularly adapted to mount on a printer 12 having a rotatable cylindrical platen 14 for receiving an envelope or other sheet material. The feeding apparatus 10 includes a support unit, generally designated by the numeral 16, which may be configured to provide for mounting the apparatus on top of the printer according to the specific design of the printer housing and platen drive mechanism. In the embodiment shown the support unit 16 includes two elongated rods 18 and 20 which support the apparatus 10 and which are interconnected by spaced apart brackets 22 and 24. The brackets 22 and 24 respectively include digitally actuatable latch members 26 and 28 which are operable to secure the apparatus 10 to the printer 12 by engagement with opposite ends of a main shaft 30 of the platen 14. The latch members 26 and 28 are conveniently located and easily digitally actuated by the printer operator to release the support unit 16 and the apparatus 10 from engagement with the printer for easy removal. FIG. 6 illustrates by way of example how the bracket 22 and the latch member 26 engage the shaft 30. The bracket 24 and the latch member 28 are similarly configured to engage the shaft 30 at the opposite end of the platen 14. As shown in FIG. 1, an adjustable foot 32 is provided for setting the angular position of the apparatus 10 with respect to the platen 14.

Figure 5:
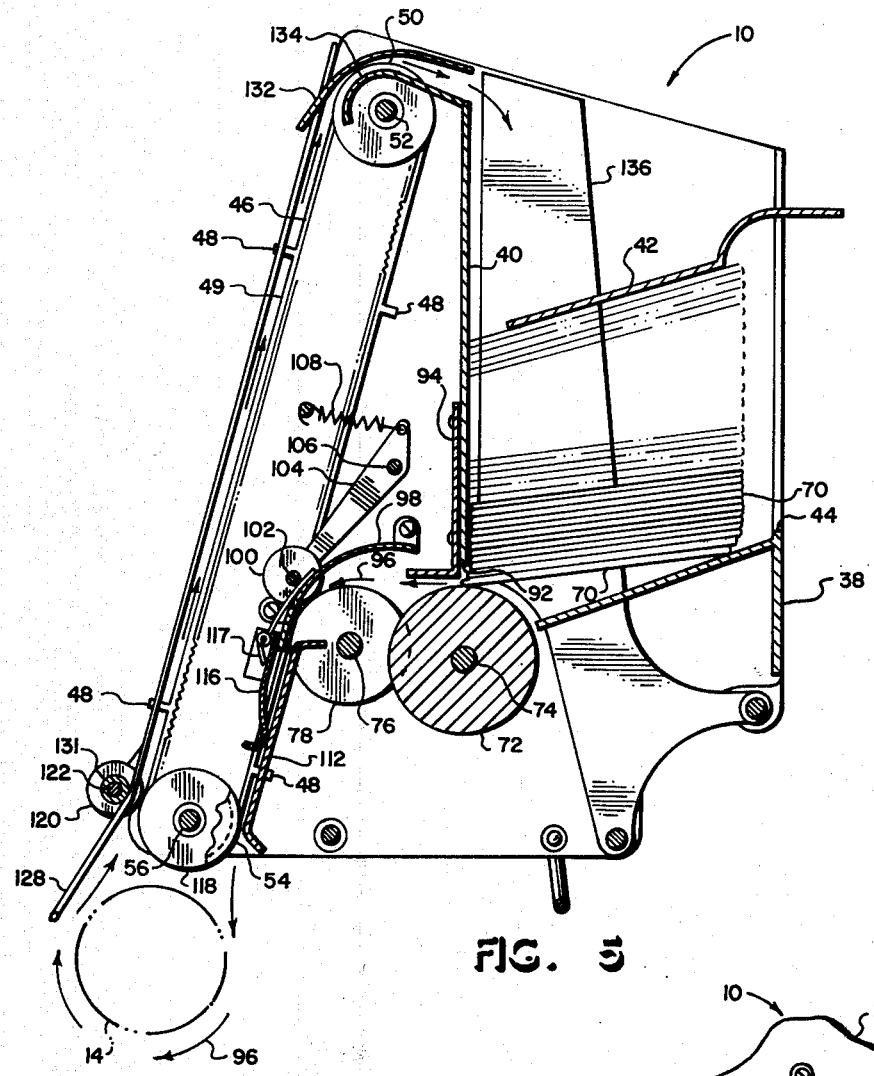
FIG. 5 is a section view taken along the line 5—5 of FIG. 4.

Referring again to FIG. 1 and FIG. 3 the apparatus 10 includes a frame comprising spaced apart side plates 34 and 36 and a rear plate portion 38. The frame of the apparatus 10 also includes an intermediate plate 40 as shown in FIG. 5, which is spaced from the rear plate portion 38 to form the front wall of an envelope magazine defined also by the plates 34 and 36 and the plate portion 38. The magazine includes a removable separator plate 42 which is vertically movable in the magazine and is guided within a recess 44 in the rear plate portion 38. The separator plate 42 is operable to separate a stack of envelopes to be dispensed from the feeding apparatus to the printer from envelopes received back to the magazine from the printer in a manner to be explained in further detail herein.

Figure 4:
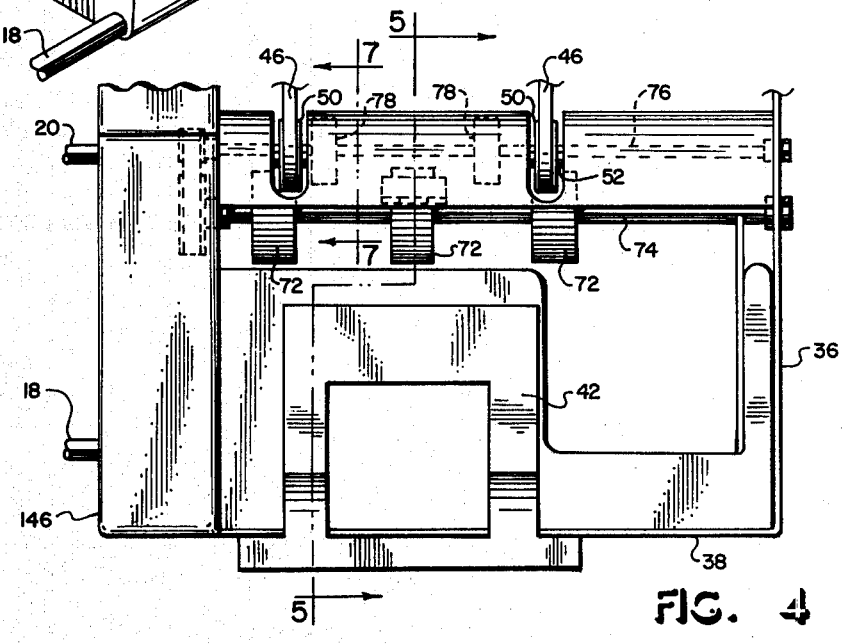
FIG. 4 is a partial plan view of the feeding apparatus.

Referring to FIGS. 1 and 5 a pair of endless toothed envelope feed belts 46 are mounted spaced apart on the apparatus 10 and are respectively trained over upper idler pulleys 50 which are rotatably mounted on an idler shaft 52 as shown in FIGS. 4 and 5. Referring again to FIG. 1 the belts 46 are also trained over respective spaced apart toothed drive pulleys 54 which are mounted on a rotatable drive shaft 56. The belts 46 are provided with a plurality of spaced apart envelope engaging lugs 48 projecting from a smooth relatively low friction surface 49 of the belts. The lugs 48 are preferably molded integral with belts 46 and are spaced apart equidistant along the belts. The lugs 48 on each of the belts are aligned with the lugs on the adjacent belts along a line substantially parallel to the longitudinal axis of the shafts 52 and 56.

As shown in FIG. 1 the shaft 56 is mounted in suitable bearings on the side plates 34 and 36. The end of the shaft 56 projecting from the side plate 34 includes a coupling 57 which connects the shaft 56 with a drive shaft 59 on which is mounted a drive gear 60. Referring also to FIG. 6 the drive gear 60 is meshed with an idler gear 62 which in turn is meshed with a drive gear 64 drivably connected to the platen shaft 30. Accordingly the belts 46 are driven by the printing apparatus and in timed relation with the platen 14. Preferably the pulleys 54 are proportioned such that the linear velocity of the belts 46 is the same as the surface or tangential velocity of the platen 14. As may be appreciated by those skilled in the art the drive mechanism for the shaft 56 may be arranged at the opposite end of the shaft to accommodate the platen drive mechanism of different printing apparatus.

The shaft 56 also includes a timing gear 58 mounted thereon adjacent to the side plate 34 as shown in FIG. 1. The gear 58 is meshed with a gear 61 rotatably mounted on the side plate 34 and fixed to a radially extending shutter 66 which is adapted to pass in proximity to a photo sensor 68. The sensor 68 is responsive to the passing of the shutter 66 to generate an electrical signal for a purpose to be explained in further detail herein.

Referring particularly to FIG. 5, the envelope magazine is adapted to receive a plurality of envelopes 70 as shown or other discrete pieces of sheet material to be printed on by the printer 12. The envelopes 70 are stacked in the magazine to be dispensed therefrom serially and spaced apart from each other by improved mechanism which includes, as shown in FIG. 4, three spaced apart rollers 72 which are fixed on and rotatably driven by a shaft 74 mounted in suitable bearings on the respective side plates 34 and 36. Referring to FIGS. 4 and 5, the envelope dispensing mechanism also includes a second rotatable shaft 76 mounted in suitable bearings disposed on the side plates 34 and 36, respectively. The shaft 76 drivably supports a second set of spaced apart rollers 78 interposed between the rollers 72 as shown in FIG. 4.

Figure 2:
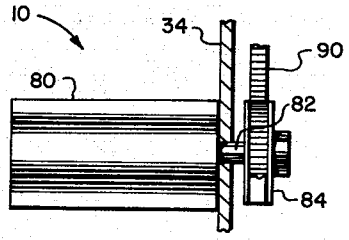
FIG. 2 is a detailed view taken substantially along the line 2—2 of FIG. 1 and showing the drive motor for the dispensing mechanism.

Referring to FIGS. 1 and 2 the dispensing mechanism is still further characterized by a motor 80 suitably mounted on the inner wall of the side plate 34 and including a drive shaft 82 extending through the side plate and on which a drive pulley 84 is mounted. As shown in FIG. 1 drive pulleys 86 and 88 are mounted on and drivably engaged with the respective shafts 74 and 76.

The pulleys 86 and 88 are of different pitch diameters. A drive belt 90 is trained over the pulleys 84, 86 and 88 to provide for driving the shafts 74 and 76 and the respective sets of rollers mounted thereon.

Referring to FIG. 5 the aforedescribed drive mechanism is operable to dispense the envelopes 70 or the like serially from the magazine through an opening formed by the lower edge 92 of the wall 40 and the rollers 72. An adjustable member 94 mounted on the wall 40 may be positioned to adjust the width of the opening between the lower edge 92 and the roller 72 to permit the dispensation of envelopes 70 from the magazine one at a time.

As the envelopes 70 are serially dispensed from the magazine they each engage the rollers 78 which are rotating at a speed to provide a tangential velocity greater than the rollers 72. Accordingly, as an envelope comes into contact with the rollers 78 it is accelerated and moved ahead of the envelope to be successively dispensed from the magazine. The tangential or linear velocity of the surface of the rollers 78 in relation to the linear velocity of the rollers 72 is determined by the respective diameters of the pulleys 86 and 88 or by the relative diameters of the respective sets of rollers. The dispensing mechanism described hereinabove includes superior separation features for spacing the envelopes along a first portion of a feed path indicated by the arrows in FIG. 5 and generally designated by the numeral 96.

Referring to FIG. 5 a guide plate 98 is provided spaced from the rollers 78 to assist in guiding the envelopes along a curved portion of the feed path 96, as shown, after the envelopes are dispensed from the magazine. The envelopes are also maintained on the curved portion of the feed path and in engagement with the rollers 78 by a pair of spaced apart rollers 100 which are rotatably mounted on a shaft 102 which in turn is mounted on a pair of spaced apart arms 104 which are pivotally mounted on the apparatus 10 by a shaft 106. The rollers 100 are yieldably biased toward the rollers 78 by a spring 108 suitably connected to the frame of the apparatus 10 and to one of the arms 104 as shown in FIG. 5. The rollers 100 and the plate 98 are operable to guide the envelopes along the feed path 96 which is further defined in part by a slot formed between a support plate 112 and the belts 46. As shown in FIG. 1 by the support plate 112 includes slots 114 formed therein to permit passing of the lugs 48 on the belts 46.

When an envelope is fed into proximity to the belts 46 along the plate 112 it is held momentarily stationary in a position against the plate 112 by a finger 116 shown in FIGS. 1 and 5. The finger 116 is pivotally mounted on the plate 98 and is yieldably biased toward the support plate 112 by a suitable torsion spring 117. When an envelope has been dispensed from the magazine and positioned in the slot formed between the belts 46 and the support plate 112 it remains there briefly until a set of lugs 48 on the respective belts 46 engage the envelope and feed it downwardly to the printer in engagement with the platen 14. Thanks to the two aligned lugs 48 on the respective belts 46 an envelope is fed into the printer in a correct attitude even though it may have been slightly skewed while being dispensed from the magazine of the feeding apparatus 10. Moreover, even though the belts 46 may be in contact with the envelope while it is waiting to be engaged by a set of lugs 48 the smooth low friction surfaces 49 of the belts do not cause the envelope to be moved until it is positively engaged by the lugs.

Referring to FIGS. 1 and 5 the shaft 56 also includes a pair of spaced apart rollers 118 mounted in fixed relation thereto to be rotatable with the shaft. The rollers 118 are engaged by a second set of rollers 120 rotatably mounted on a supporting shaft 122 which is supported at its opposite ends by brackets 124. The brackets 124 are pivotally mounted on the respective side plates 34 and 36 and are connected to tension coil springs 126 so as to bias the rollers 120 into engagement, respectively, with the rollers 118. As an envelope is rolled out of the platen 14 after completion of a printing operation it is guided between the rollers 120 and 118 assisted by a rod like guide member 128 which, as shown in FIG. 1, is a somewhat U shaped member extending upward into spaced apart openings 130 formed in a deflector plate 132 extending between the side plates 34 and 36. The guide member 128 includes a tubular bushing 131 which is supported on the shaft 122 between the rollers 120. As will be apreciated from the foregoing description the guide member 128 and the rollers 120 may be moved away from the belts 46, if desired, to remove envelopes being conveyed upward by the belts on the return trip to the magazine of the apparatus 10.

The rollers 118 and 120 together with the belts 46 and the guide member 128 provide for conveying the envelopes from the platen 14 back to the magazine. As an envelope is ejected from the platen 14 it is directed by the distal end of the guide member 128 between the rollers 118 and 120. The rollers 118 are preferrably made of a relatively soft material such as natural rubber and are positively driven in synchronism with the belts 46. Moreover, the diameter of the rollers 118 is substantially equal to the diametral dimension of the belts on the drive pulleys 54 so that the surface speed of the rollers and the belts are substantially the same. Furthermore, the lugs 48 on the belts 46 are spaced apart sufficiently to permit one set of lugs to convey an envelope into the platen 14 whereby the following set of lugs engages an envelope as it leaves the platen and is engaged by the rollers 118 and 120 to be drawn into position between the guide member 128 and the belts.

Referring to FIG. 5 an envelope is conducted along the return portion of the feed path 96 as indicated by the arrows between the deflector plate 132 and an uppermost curved portion 134 of the plate 40 and back into the magazine of the apparatus 10. As previously indicated the separator plate 42 provides a divider between the envelopes which are being fed into the printer and the envelopes being returned from the printer. As shown in FIG. 3 also the magazine includes a movable wall member 136 mounted on a bracket 138 which is slidable on a rod 140 supported between the side plates 34 and 36. The movable wall 136 may be positioned along the rod 140 as desired according to the length of envelopes or other sheet material to be dispensed from the magazine of the apparatus 10.

Figure 7:
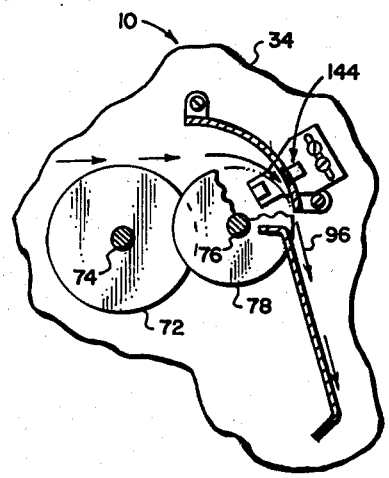
FIG. 7 is a detail section view taken substantially from the line 7—7 of FIG. 4.

The feeding apparatus 10 is suitably controlled to feed envelopes or similar discrete pieces to be printed from the magazine into the printer 12 and back to the magazine at suitably spaced apart intervals to provide for printing one or more lines of type on each envelope. In order for an envelope to be dispensed from the magazine of the apparatus 10 and positioned against the plate 112 in properly timed relation to the position of a set of lugs 48 the drive motor 80 must be controlled to be energized at a predetermined time in relation to the position of a set of lugs 48, and furthermore, the motor 80 must be de-energized to stop the dispensing operation when an envelope has been disposed to the position against the plate 112 awaiting engagement by a set of lugs 48 to prevent feeding successive envelopes too close together or overlapping each other. Thanks to the differential surface or tangential velocities of the respective sets of rollers 72 and 78 the envelopes are separated as they leave the magazine. Referring to FIG. 7 the apparatus 10 includes a photosensor 144 similar to the photosensor 68 and adjustably mounted on the inside of the side plate 34 and along the feed path 96 as shown. A portion of the deflector plate 98 is cut away to permit the photosensor to view an envelope as it passes along the portion of the feed path 96 which passes through the photosensor as shown in FIG. 7 and also indicated in the schematic diagram of FIG. 8. Accordingly the photosensor 144 is operable to detect when the envelope has passed a predetermined point along the feed path 96 to provide a signal to de-energize the motor 80 to stop the dispensing operation until another signal from the sensor 68 is generated to cause the motor to be energized again.

The sensor 68 generates a signal in a predetermined time relationship to the position of a set of lugs 48 on the belts 46 by setting the mesh of the gears 58 and 61 so that the shutter 66 passes the sensor 68 when a set of lugs is in a certain position which will result in engagement of an envelope after the envelope has been dispensed from the magazine and placed against the support plate 112.

The sensors 68 and 144 both provide signals to a control circuit shown schematically in FIG. 8 and generally designated by the numeral 145. The control circuit 145 may be conveniently located in a housing 146 mounted on the side plate 34 as shown in the FIGS. 1 and 3.

Referring to FIG. 8 the control circuit 145 includes a connector 148 which is operable to be connected to a source of electric power for the control circuit. Such a source of power may be from the printer 12 or from an independent power supply as desired. In a preferred embodiment of the control circuit according to the present invention the connector 148 includes a line 149 carrying a suitable DC voltage for operation of the control components in the circuit 145 and a line 150 for supplying a suitable DC voltage for operation of the drive motor 80. The sensor 68 is preferably an optical source sensor assembly comprising a photo transistor and a light emitting diode as indicated by the schematic of FIG. 8 and which provides a suitable signal when the shutter 66 interrupts the light beam generated by the sensor. The signal generated by the passing of the shutter 66 is amplified and shaped by a circuit generally designated by the numeral 152 which provides a signal in line 153 to an electronic timer generally designated by the numeral 154 and to a flip flop circuit generally designated by the numeral 156. A signal from the circuit 152 to the timer 154 also provides a signal at the output 158 which is operable to cause a switching circuit 160 to turn on the motor 80. The motor 80 may be a relatively inexpensive DC gear motor and is desirably provided with a capacitor 162 for eliminating stray signals which may adversely affect the circuit 145, and a diode 164 which eliminates a back EMF to reduce motor coasting and brush sparking when the motor is de-energized.

The sensor 144 is also characterized by a photo transistor and a light emitting diode as indicated by the schematic of the circuit diagram of FIG. 8. When an envelope 70 has passed along the feed path 96 and through the sensor 144 a signal is generated which is amplified and shaped by a circuit 166 which provides an output signal to the flip flop circuit 156. If a signal of increasing magnitude is presented at the terminal 168 of the flip flop circuit 156 in the presence of a signal at the terminal 170 an output signal is generated at terminal 172 which causes a transistor 174 to provide a low magnitude signal at terminal 176 of the timer 154 which turns off the timer and causes a change in the signal in the line 158 resulting in deenergizing the motor 80 through the switching circuit 160. Accordingly when an envelope 70 has passed the sensor 144 an operating cycle is complete and the motor 80 will restart only when the shutter 66 again passes the sensor 68. Moreover, the motor 80 is controlled to dispense envelopes from the magazine of the apparatus 10 only when a preceding envelope has cleared the sensor 144 and the belt drive mechanism has moved the belts to engage an envelope and remove it from the support plate 112.

If an envelope 70 becomes jammed in the feed path 96 the sensor 144 will not sense the end of the envelope and a signal of increasing magnitude will not be generated and made available at the terminal 168 of the flip flop 156. Accordingly an output signal of increased magnitude is not available at terminal 172. Under such a condition the timer 154 is not turned off and once the preset time expires a low magnitude output signal is conducted to the motor switch control circuit 160 to turn off the motor. Moreover, a combined condition of a low magnitude signal at a terminal 178 of a circuit 180 and a signal at terminal 182 reflecting a low magnitude signal from the output 158 will produce an output signal of relatively high magnitude at terminal 184 of the circuit 180. A high magnitude signal at terminal 184 will cause a pulsing switch circuit 186 to generate an intermittent signal to a horn 188 and a warning light 190 to indicate an error conduction in the feeding apparatus 10. A manual switch 192 is operable to provide a reset pulse to the circuit 180 to turn off the horn 188 and light 190. As long as a high magnitude signal is present at the terminal 184 a transistor 194 provides a low magnitude signal at terminal 176 of the timer 154 resulting in a low magnitude signal at 158 which prevents restarting of the motor 80 regardless of any signal received from the circuit 152 to the timer 154.

The circuit illustrated in FIG. 8 also indicates a line 198 which conducts an error signal from the circuit 180 which may be used to turn off the printer 12, for example.

The control circuit 145 also includes a signal generating circuit designated by the numeral 200 for reseting the flip flop circuit 156 and the circuit 180 to a ready state each time power is turned on to the control circuit 145. The control circuit of FIG. 8 further includes a manual switch 202 for operating the motor 80 independently to assist in clearing a jammed condition of the feed path, or example.

The control circuit 145 is also operable to shut off the motor 80 if an envelope fails to pass through the sensor 144 such as would occur if the magazine was empty or if the envelopes were jammed in the magazine. If an envelope fails to pass through the sensor 144 the circuit 166 would fail to generate a signal of increasing magnitude at the terminal 168 resulting in a condition of the control circuitry which is the same as caused by a jamming envelope, that is, a low magnitude signal would be emitted from the timer 154 and the flip flop circuit 156 which would cause the circuit 180 to generate an output signal for turning on the horn 188 and the light 190 and for maintaining a low magnitude signal at the terminal 176 of the timer 154 thereby preventing the switching circuit 160 from energizing the motor 80 until the circuit is reset by the switch 192. Accordingly, the circuit 145 shown in FIG. 8 is operable to provide for a normal operating cycle of the feeding apparatus 10 as well as provide suitable malfunction and motor shut off control.

In operation, the feeding apparatus 10 is easily mounted on the printer 12 by positioning the brackets 22 and 24 on the shaft 30 of the platen 14 and releasing the clamp members 26 and 28 to lock the support unit in its proper position. The connector 148 is then plugged into a suitable receptacle in the printer 12 or other power supply means. Proper timing of the shutter 66 in relation to a set of lugs 48 on the belts 46 would normally be preset. However, if required the gear 61 is provided to be easily demountable from the side plate 34 to change the angular position of the shutter 66 with respect to the drive shaft 56 to arrange for the proper timing of dispensing of an envelope from the magazine. When power is supplied to the printer to rotate the platen 14 the shaft 56 and gear 61 will be rotated until the shutter 66 passes in proximity to the sensor 68 whereupon the motor 80 will be energized to dispense an envelope from the magazine of the apparatus 10 along the feed path to the support plate 112 whereby the envelope will be momentarily held until a set of lugs 48 engage the envelope to feed it into the platen 14. When the platen 14 is advanced until an envelope is in correct position for printing printing is commenced and when completed the platen is rotated to eject an envelope along the feed path as indicated by the arrows in FIG. 5. As an envelope is ejected from the platen 14 it is guided between the rollers 118 and 120 by the distal end of the guide member 128. The rollers 118 and 120 operate to feed the envelope into position in engagement with the belts 46 whereby the envelope awaits engagement by the lugs 48 before being transported upward along the feed path and between the deflector plate 132 and the portion 134 of the plate 40 whereupon the envelope is discharged back into the magazine on top of the plate 42. Each time the shutter 66 passes the sensor 68 the motor 80 is energized to dispense an envelope from the magazine and into the holding position against the support plate 112 where it is momentarily held by the finger 116 until engagement by lugs 48 on the belts 46. In the unlikely event that an envelope should become jammed at some point along the feed path the simplified and open construction of the apparatus 10 provides for easy clearing operations to be performed.

What is claimed is:

1. A feeding apparatus for discrete pieces of sheet material such as envelopes for use in connection with a printer having an independently operable rotating platen, said feeding apparatus comprising:

magazine means for holding a plurality of stacked envelopes and including an outlet through which said envelopes may be serially dispensed along a feed path leading to said platen;

means engageable with an envelope in said magazine means for dispensing said envelope from said magazine means along a first portion of said feed path;

holding means defining a part of said feed path for holding said envelope dispensed from said magazine means;

feed means operable in time relationship to the rotation of said platen for feeding said envelope along a second portion of said feed path, said feed means including means for positively engaging said envelope held by said holding means to feed said envelope to said platen and releasing engagement with said envelope when said envelope becomes engaged by said platen; and control means for actuating said dispensing means in timed relation to the operation of said feed means for dispensing an envelope from said magazine means to said holding means.

2. The invention set forth in claim 1 wherein:

said feeding apparatus includes means for guiding an envelope being ejected from said platen along a return portion of said feed path for engagement by said feed means to convey said envelope to a receiving magazine.

3. The invention set forth in claim 2 wherein:

said feed means comprises endless belt means and said means for positively engaging said envelopes includes spaced apart lugs on said belt means.

4. The invention set forth in claim 3 wherein:

said feeding apparatus includes a drive shaft operable to be rotatably driven in timed relationship to the rotation of said platen, belt drive pulley means mounted on said shaft and driveably engaged with said belt means, first roller means mounted on said shaft and forming a part of said guide means for receiving said envelope from said platen and for positioning said envelope to be engaged by said lugs on said belt means.

5. The invention set forth in claim 4 wherein:

said guide means includes idler rollers resiliently biased toward said first roller means.

6. The invention set forth in claim 2 wherein:

said guide means includes an elongated guide member disposed along the portion of said feed path between said platen and said receiving magazine.

7. The invention set forth in claim 1 together with:

a member adjustably mounted on said apparatus for determining the size of said outlet to prevent the dispensing of more than one envelope from said magazine during an operating cycle of said dispensing means.

8. The invention set forth in claim 1 wherein:

said dispensing means comprises first roller means engageable with an envelope in said magazine for moving said envelope through said outlet.

9. The invention set forth in claim 8 wherein:

said dispensing means includes second roller means disposed along the feed path in the direction of feeding of said envelope with respect to said first roller means, said second roller means being driven at a tangential velocity greater than said first roller means for spacing an envelope being dispensed from said magazine a predetermined distance from the next envelope to be dispensed from said magazine.

10. The invention set forth in claim 9 together with:

a motor driveably engaged with said first and second roller means for driving said roller means simultaneously.

11. The invention set forth in claim 3 wherein:

said holding means comprises means forming a stationary surface disposed adjacent to said endless belt means for receiving an envelope and holding said envelope for engagement by said lugs.

12. The invention set forth in claim 11 wherein:

said holding means includes a holding member yieldably biased toward said surface for engaging an envelope to hold said envelope on said surface until said envelope is engaged by said lugs on said belt means.

13. The invention set forth in claim 9 wherein:

said apparatus includes means forming a guide surface for an envelope spaced from said second roller means and defining a curved portion of said feed path.

14. The invention set forth in claim 9 together with:

means yieldably biasing an envelope into engagement with said second roller means.

15. The invention set forth in claim 1 wherein:

said apparatus includes a support for removably mounting said apparatus on said printer, said support including releasable clamp means operable to releasably secure said apparatus to said printer.

16. The invention set forth in claim 15 wherein:

said clamp means includes a pair of spaced apart clamp members pivotably mounted on said support and cooperable with means on said support to retain said apparatus on said printer in a position to provide for feeding an envelope to and receiving an envelope from said platen.

17. The invention set forth in claim 16 wherein:

said platen includes a support shaft and said clamp members are engageable with said support shaft.

18. The invention set forth in claim 15 wherein:

said platen includes a drive gear, and said feed means includes a rotatable drive shaft and gear means drivably interconnecting said drive gear and said drive shaft for driving said feed means in timed relationship to the rotation of said platen.

19. The invention set forth in claim 18 wherein:

said gear means includes an idler gear meshed with said drive gear and a driven gear meshed with said idler gear and driveably connected to said drive shaft of said feed means.

20. The invention set forth in claim 1 wherein:

said dispensing means includes an electric drive motor, and said control means includes a control circuit including switch means for starting and stopping said motor, said control circuit including a first sensor operable to generate a signal related to a predetermined position of said means for positively engaging said envelope to affect the starting of said motor to dispense an envelope from said magazine means, a second sensor operable to generate a signal responsive to said envelope passing a predetermined point on said feed path to effect the stopping of said motor, and means in said circuit for generating an error signal upon failing to receive a signal from said second sensor after a predetermined period of time commencing with the generation of a signal by said first sensor.

21. The invention set forth in claim 20 wherein:

said first sensor is a photosensor and said feed means includes a shutter movable in timed relationship to the movement of said means for positively engaging said envelope for causing said photosensor to generate said signal to effect the starting of said motor.

22. The invention set forth in claim 21 wherein:

said second sensor is a photosensor operable to generate a signal only in response to an envelope passing a predetermined point on said feed path.

23. The invention set forth in claim 22 wherein:

said control circuit includes means responsive to receiving said signal from said second sensor to cause said switch means to effect the stopping of said motor and to permit a signal from said first sensor to effect the restarting of said motor.

24. The invention set forth in claim 23 wherein:

said control circuit includes means responsive to receiving said error signal for preventing the restarting of said motor, said control circuit further including manually actuatable reset means operable to condition said control circuit for restarting said motor in response to a signal generated by said first sensor.

25. The invention set forth in claim 1 together with:

support means for said feeding apparatus including quick release clamping means for releasably securing said feeding apparatus on said printer.

26. The invention set forth in claim 25 together with:

a drive mechanism mounted on said support means and engageable with a cooperable drive mechanism on said platen and drivably interconnecting said platen and said drive means for said endless belt means for operating said endless belt means in timed relation to the rotation of said platen.

27. The invention set forth in claim 25 wherein:

said clamping means include spaced apart digitally actuatable clamp members for releasably clamping said apparatus to shaft means for said platen.

28. The invention set forth in claim 26 wherein:

said drive mechanism on said platen includes a gear drivably connected to said platen, and said drive mechanism on said support means includes a driven gear train operable to be meshed with said gear and drivably connected to said belt means.

29. The invention set forth in claim 28 wherein:

said apparatus includes a drive shaft rotatably mounted on said frame and including drive pulley means for driving said belt means, and said drive mechanism includes a coupling interconnecting said drive shaft and said gear train.

30. A feeding apparatus for envelopes for use in connection with a printer having an independently operable rotating platen for receiving and ejecting said envelopes, said feeding apparatus comprising:

a magazine for holding a plurality of stacked envelopes and including an outlet through which said envelopes may be serially dispensed along a feed path leading to said platen;

dispensing means engageable with an envelope in said magazine for dispensing said envelope from said magazine through said outlet, said dispensing means including means for changing the direction of said feed path from a substantially horizontal direction to a substantially vertical direction leading to said platen;

holding means including means forming a stationary surface for receiving said envelope from said dispensing means and holding said envelope momentarily stationary; and, feed means operable in timed relationship to the rotation of said platen for positively engaging said envelope on said holding means and feeding said envelope further along said feed path toward said platen, said feed means being operable to release engagement with said envelope when said envelope becomes engaged by said platen and reengage said envelope when said envelope is ejected from said platen.

31. The invention set forth in claim 30 wherein:

said holding means comprises a support plate and means resiliently biased toward said support plate and engageable with said envelope to hold said envelope momentarily stationary on said support plate.

32. The invention set forth in claim 31 wherein:

said feed means comprises endless belt means disposed adjacent to said support plate, and said means for positively engaging said envelope includes spaced apart lugs on said belt means.

33. The invention set forth in claim 30 wherein:

said means for changing the direction of the feed path comprises means for forming a curved portion of said feed path including drive roller means of said dispensing means engageable with said envelope for feeding said envelope along said curved portion of said feed path.

34. The invention set forth in claim 33 together with:

idler roller means resiliently biased toward said drive roller means for holding said envelope in engagement with said drive roller means along said curved portion of said feed path.

35. The invention set forth in claim 34 wherein:

said curved portion of said feed path is defined in part by a curved deflector plate disposed adjacent to and spaced from said drive roller means.

36. A feeding apparatus for discrete pieces of sheet material such as envelopes for use in connection with a printer having an independently operable rotating platen, said feeding apparatus comprising:

magazine means for holding a plurality of stacked envelopes and including an outlet through which said envelopes may be serially dispensed along a feed path leading to said platen;

means engageable with an envelope in said magazine means for dispensing said envelope from said magazine means along a first portion of said feed path;

holding means defining a part of said feed path for holding said envelope momentarily stationary;

feed means comprising endless belt means operable in timed relationship to the rotation of said platen for feeding said envelope along a second portion of said feed path, said feed means including spaced apart lugs on said belt means for positively engaging said envelope to feed said envelope to said platen;

a drive shaft operable to be rotatably driven in timed relationship to the rotation of said platen, and belt drive pulley means mounted on said shaft and drivably engaged with said belt means;

guide means including first roller means mounted on said drive shaft for guiding an envelope being ejected from said platen along a return portion of said feed path and for positioning said envelope for engagement by said lugs to convey said envelope to a receiving magazine; and, control means for actuating said dispensing means in timed relation to the operation of said feed means for dispensing an envelope from said magazine means to said holding means.

37. A feeding apparatus for discrete pieces of sheet material such as envelopes for use in connection with a printer having an independently operable rotating platen, said feeding apparatus comprising:

magazine means for holding a plurality of stacked envelopes and including an outlet through which said envelopes may be serially dispensed along a feed path leading to said platen;

dispensing means including first roller means engageable with an envelope in said magazine means for dispensing said envelope from said magazine means by moving said envelope through said outlet and along a first portion of said feed path, and second roller means disposed along the feed path in the direction of feeding of said envelope with respect to said first roller means, said second roller means being driven at a tangential velocity greater than said first roller means for spacing an envelope being dispensed from said magazine a predetermined distance from the next envelope to be dispensed from said magazine;

holding means defining a part of said feed path for holding said envelope momentarily stationary;

feed means operable in timed relationship to the rotation of said platen for feeding said envelope along a second portion of said feed path, said feed means including means for positively engaging said envelope to feed said envelope to said platen; and control means for actuating said dispensing mean in timed relation to the operation of said feed means for dispensing an envelope from said magazine means to said holding means.

38. A feeding apparatus for discrete pieces of sheet material such as envelopes for use in connection with a printer having an independently operable rotating platen, said feeding apparatus comprising:

magazine means for holding a plurality of stacked envelopes and including an outlet through which said envelopes may be serially dispensed along a feed path leading to said platen;

an electric drive motor drivably engaged with means engageable with an envelope in said magazine means for dispensing said envelope from said magazine means along a first portion of said feed path;

holding means defining a part of said feed path for holding said envelope momentarily stationary;

feed means operable in timed relationship to the rotation of said platen for feeding said envelope along a second portion of said feed path, said feed means including means for positively engaging said envelope to feed said envelope to said platen; and control means for actuating said dispensing means in timed relation to the operation of said feed means for dispensing an envelope from said magazine means to said holding means, said control means including a control circuit including switch means for starting and stopping said motor, a first sensor comprising a photosensor operable to generate a signal related to a predetermined position of said means for positively engaging said envelope, a shutter movable in timed relationship to the movement of said means for positively engaging said envelope for causing said photosensor to generate said signal to effect the starting of said motor to dispense an envelope from said magazine means, a second sensor operable to generate a signal responsive to said envelope passing a predetermined point on said feed path to effect the stopping of said motor, and means in said circuit for generating an error signal upon failing to receive a signal from said second sensor after a predetermined period of time commencing with the generation of a signal by said first sensor.

39. A feeding apparatus for discrete pieces of sheet material such as envelopes for use in connection with a printer having a rotating platen, said feeding apparatus comprising:

magazine means for holding a plurality of stacked envelopes and including an outlet through which said envelopes may be serially dispensed along a feed path leading to said platen;

means engageable with an envelope in said magazine means for dispensing said envelope from said magazine means along a first portion of said feed path;

holding means defining a part of said feed path for holding said envelope dispensed from said magazine means;

feed means comprising endless belt means operable in timed relationship to the rotation of said platen for feeding said envelope along a second portion of said feed path, said belt means including means for positively engaging said envelope to feed said envelope to said platen;

a drive shaft operable to be rotatably driven in timed relationship to the rotation of said platen and including drive pulley means drivably engaged with said belt means;

guide means for guiding an envelope being ejected from said platen along a return portion of said feed path and for positioning said envelope for engagement by said means for positively engaging said envelope to convey said envelope to a receiving magazine; and, control means for actuating said dispensing means in timed relation to the operation of said feed means for dispensing an envelope from said magazine means to said holding means.

40. A feeding apparatus for discrete pieces of sheet material such as envelopes for use in connection with a printer having an independently operable rotating platen, said feeding apparatus comprising:

magazine means for holding a plurality of stacked envelopes and including an outlet through which said envelopes may be serially dispensed along a feed path leading to said platen;

means engageable with an envelope in said magazine means for dispensing said envelope from said magazine means along a first portion of said feed path;

holding means defining a part of said feed path for holding said envelope;

feed means operable in timed relationship to the rotation of said platen for feeding said envelope along a second portion of said feed path, said feed means including means for positively engaging said envelope to feed said envelope to said platen; and control means including sensing means for sensing a predetermined amount of platen rotation for actuating said dispensing means in direct response to said predetermined amount of platen rotation for dispensing an envelope from said magazine means to said holding means.

41. The apparatus set forth in claim 40 wherein:

said apparatus includes drive means for directly interconnecting said platen and said feed means, and said control means includes a control circuit including said sensing means for producing a control signal in response to said predetermined amount of platen rotation.

42. The apparatus set forth in claim 41 wherein:

said sensor means includes a timing gear rotatably mounted on said apparatus and meshed with gear means drivenly engaged with said drive means.

43. The apparatus set forth in claim 42 wherein:

said sensor means includes a photosensor and a shutter rotatable with said timing gear and cooperable with said photosensor to generate said control signal.

* * * * *

UNITED STATES PATENT AND TRADEMARK OFFICE

CERTIFICATE OF CORRECTION

PATENT NO. : 4,340,314

DATED : July 20, 1982

INVENTOR(S) : Michael A. Berger

It is certified that error appears in the above—identified patent and that said Letters Patent is hereby corrected as shown below:

Column 5, line 47, cancel "by".

Column 11, line 25, in claim 16, cancel " includes" and insert —include—.

Signed and Sealed this

*Tenth* Day of *May 1983*

[SEAL]

*Attest:*

GERALD J. MOSSINGHOFF

*Attesting Officer*

*Commissioner of Patents and Trademarks*